United States Patent [19]

Haney, III et al.

[11] Patent Number: 4,629,472

[45] Date of Patent: Dec. 16, 1986

[54] METHOD AND APPARATUS FOR IMPROVING COMBUSTION, THERMAL EFFICIENCY AND REDUCING EMISSIONS BY TREATING FUEL

[75] Inventors: William M. Haney, III, Westport; James C. Sullivan, Southport, both of Conn.

[73] Assignee: Fuel Tech, Inc., Stamford, Conn.

[21] Appl. No.: 810,076

[22] Filed: Dec. 17, 1985

Related U.S. Application Data

[63] Continuation-in-part of Ser. No. 746,551, Jun. 19, 1985, abandoned, which is a continuation of Ser. No. 516,094, Jul. 22, 1983, abandoned.

[51] Int. Cl.[4] ..... C10L 1/32

[52] U.S. Cl. ..... 44/51; 44/68

[58] Field of Search ..... 44/51, 68

[56] References Cited

U.S. PATENT DOCUMENTS

| | | | |
|---|---|---|---|
| 2,460,700 | 2/1949 | Lyons | 44/68 |
| 2,927,849 | 3/1960 | Greblick | 44/51 |
| 3,006,742 | 10/1961 | Brown et al. | 44/68 |
| 3,130,017 | 4/1964 | Shapiro et al. | 44/68 |
| 3,348,932 | 10/1967 | Kukin | 44/51 |

*Primary Examiner*—Mrs. Y. Harris-Smith

*Attorney, Agent, or Firm*—St. Onge Steward Johnston & Reens

[57] ABSTRACT

Apparatus and processes are disclosed for treating liquid fuels to include precious metal catalysts dispersed within a liquid which is dispersed within the fuels. The precious metal catalysts are preferably present at a level of from about 0.005 to 0.5 ppm by weight of the treated fuel, and the liquid is preferably present at a level of from about 3 to about 15% by volume of the fuel. The fuel is treated prior to introduction into a chamber for combustion.

16 Claims, 4 Drawing Figures

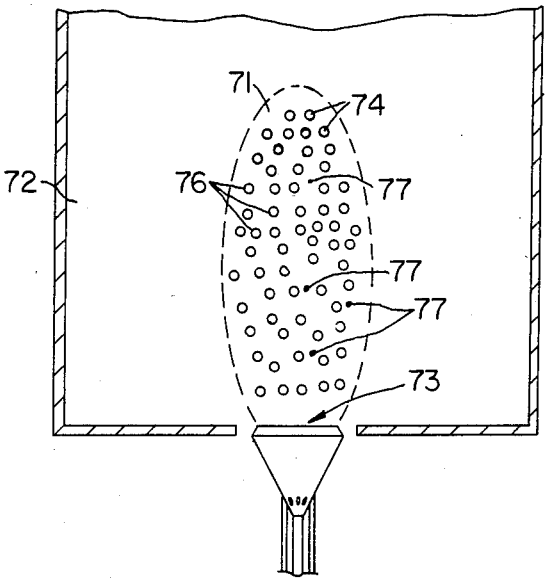
FIG.4
FIG.2
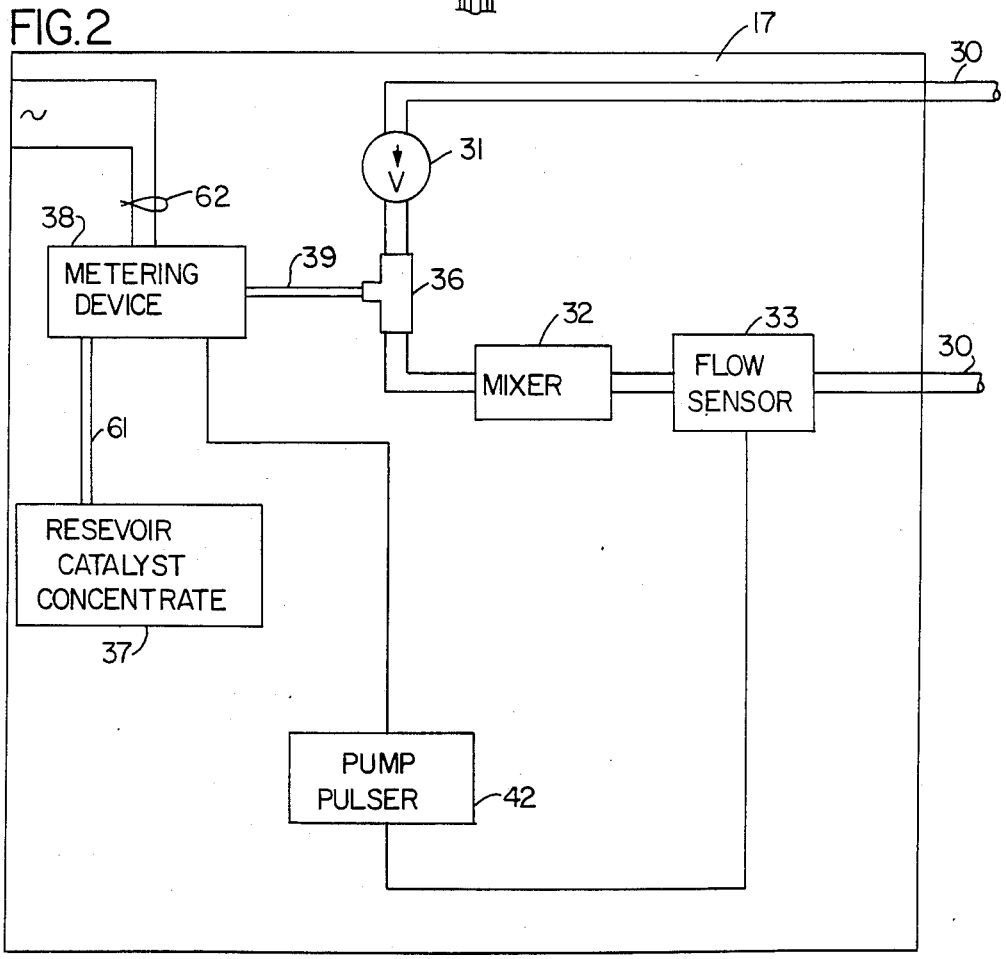

51
52
56
53
FAN
55
57
53
PREHEATER
61
58
63
FILTER
EMUL.
CATALYST METERING APPARATUS
53
53
60
62
END USER OIL TANK

METHOD AND APPARATUS FOR IMPROVING COMBUSTION, THERMAL EFFICIENCY AND REDUCING EMISSIONS BY TREATING FUEL

RELATED APPLICATIONS

This application is a Continuation-In-Part of copending U.S. application Ser. No. 746,551, filed June 19, 1985, now abandoned which in turn is a continuation of U.S. application Ser. No. 516,094, filed July 22, 1983, now abandoned.

BACKGROUND OF THE INVENTION

It has been suggested that certain advantages can be attained by the controlled introduction of catalytic materials into combustion chambers along with the air, fuel and other fluids introduced. (See U.S. Pat. Nos. 2,460,700 to Lyons; 3,862,819 to Wentworth; 4,014,637 to Schena and 4,214,615 to Boyer and see British Pat. Nos. 1,381,936 and 1,191,464.)

Steam or air atomization of catalyzed fuel just prior to its introduction into combustion chambers has also been suggested in U.S. patent application Ser. No. 473,951 to Osgerby, filed Mar. 10, 1983 which application is assigned to the assignee of the present application.

Fuel oils and other carbonaceous fuels in liquid form such as coil-oil or coal-water slurries for industry and home use vary in viscosity, BTU value, specific gravity, flash point and other characteristics including sulfur content. Such fuels also vary in price making it desirable to burn the cheaper fuels provided desired burning characteristics and emissions requirements can be met.

Less expensive heavier fuel oils, commonly referred to as #4 or #6, have the advantage of having higher BTU values than the lighter distillate (e.g., #2) fuel oils. Unfortunately, these heavier and cheaper fuels do not burn as completely or cleanly as the more expensive lighter distillate fuels. Specifically, heavier fuels have lower combustion efficiencies and higher particulate emissions than do lighter fuels. The industry has been aware that treating cheaper fuels to burn with characteristics of more expensive fuels is desirable provided treatment costs are low; however, prior fuel treatments have been unsatisfactory for most applications.

SUMMARY OF THE INVENTION

Broadly, the present invention is a method and apparatus for treating liquid fuels comprising preparing a liquid medium by metering a controlled amount of an active precious metal catalyst such as a platinum group metal, into an emulsifying liquid such as water. The liquid medium, along with stabilizing agents (if necessary for storage stability), is then mixed through agitation, collision, shearing, homogenization or other turbulent means with liquid fuel to produce an emulsion suspension which is delivered under pressure to the combustion chamber for burning. Mixing of the liquid fuel, liquid medium and catalyst may be accomplished by first mixing any two together and then adding the third, or by mixing all three at once.

It is a feature that the emulsion suspension may be stored for substantial lengths of time after such treatment.

It is a further feature that the following benefits are obtained by the fuel treatment of the prevent invention:

1. Improved combustion and thermal efficiency;

2. Reduced flue gas emissions (particulates and pollutants);
3. Reduced fireside fouling rate;
4. Suppression of $NO_x$ and $SO_3$ production; and
5. Decreased minimum excess air capability.

It is also a feature of the invention that, due to the enhanced combustibility of the emulsified suspension, the capability exists to utilize cheaper liquid fuel in lieu of the more expensive light distillate fuels. That is accomplished with minor and inexpensive equipment modifications to combustion systems originally designed to burn light distillate fuels exclusively, and without the deleterious environmental consequences usually associated with burning heavier fuel oils.

BRIEF DESCRIPTION OF THE DRAWINGS

FIG. 2 shows a catalyst metering device for use in preparing the aqueous catalyst medium.

FIG. 4 is a plan view of a flame zone in the burner illustrating the formation of droplets and micro-explosions as the fuel emulsion suspension is injected into the chamber and burned therein.

DESCRIPTION OF THE PREFERRED EMBODIMENTS

Figure 1:
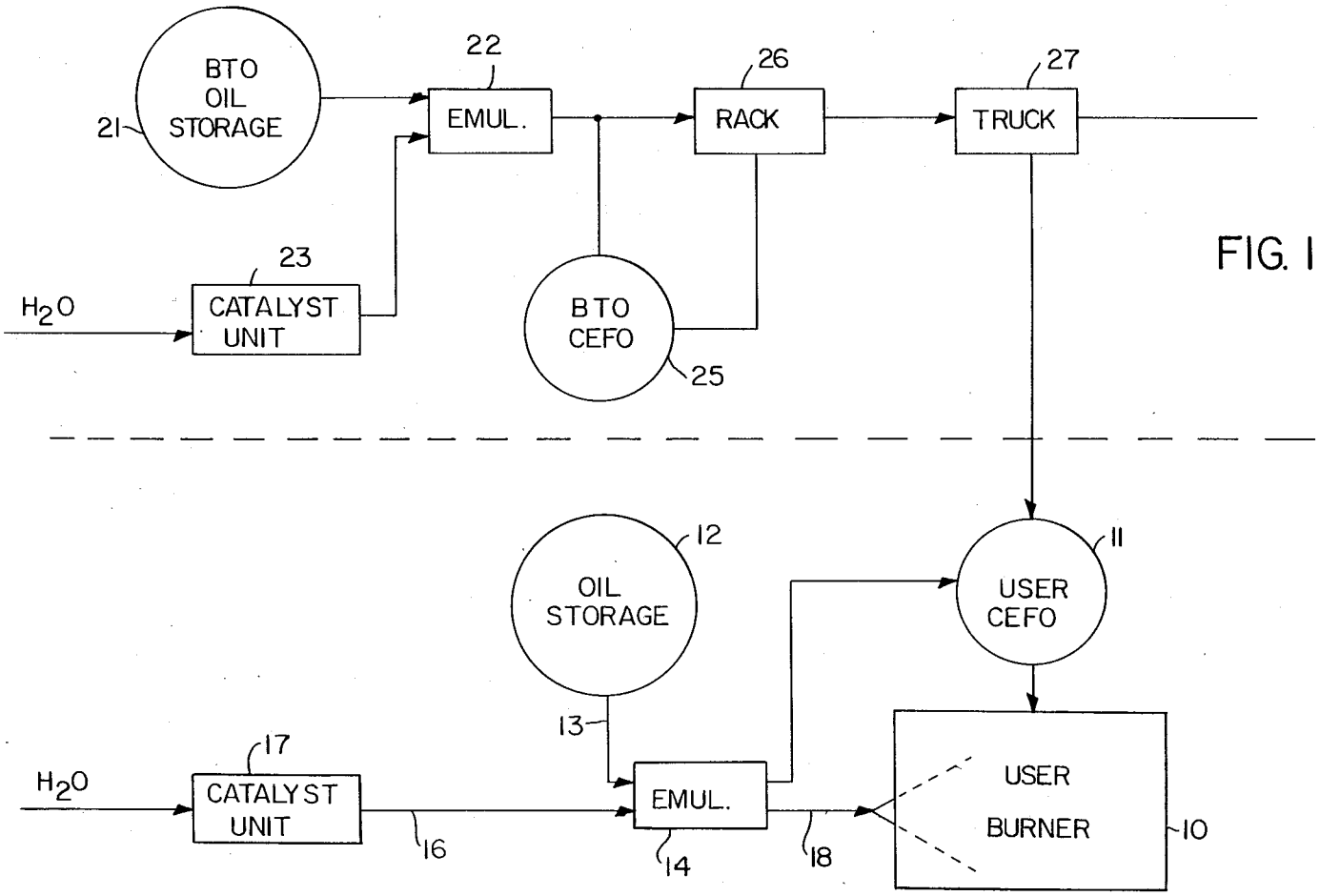
FIG. 1 is a schematic of an on-site fuel treating arrangement and a bulk terminal facility treating and delivering arrangement.

The methods and apparatus for treating, storing, and burning the emulsion suspension sometimes herein referred to as catalyzed emulsified fuel oil (or CEFO) are further understood by turning to FIG. 1 in which the end user's burner 10 is supplied with the emulsion suspension (CEFO) in two alternative ways. First, production of CEFO is accomplished in-line at the end-user's facility and, secondly production of CEFO is done at a remote bulk terminal facility for later transportation to an end user's facility. The end user's furnace combustion chamber 10 is supplied with CEFO as continuously prepared or as supplied from the user's CEFO storage tank. Untreated fuel oil stored in an oil tank 12 is led via oil feed-line 13 to emulsifier mixer 14. Simultaneously emulsifier mixer 14 is supplied with catalyzed water through water feed-line 16. Catalyst metering device 17 meters into the water in water line 16 controlled amounts of precious metal catalyst. Emulsifier 14 includes a control mechanism for controlling the ratio of water to fuel supplied to the emulsifier. The aqueous catalyst medium and fuel oil flow into emulsifier 14 where an emulsion suspension of fuel oil, water, and catalyst is produced. This emulsion suspension is then delivered to combustion chamber 10 along CEFO feed-line 18 for burning.

Alternatively, CEFO is produced and delivered by truck or other conveyance to the end-user. Turning again to FIG. 1, fuel from the supplier's storage tank 21 and an aqueous catalyst from catalyst unit 23 are supplied to and treated in emulsifier 22. Catalyst unit 23 adds selected quantities of catalyst to the water as it flows to emulsifier 22. CEFO formed in emulsifier 22 may be directed to longer term storage tank 25 or directly to shorter term rack storage 26. From rack 26, CEFO is loaded onto truck 27 for delivery to the end-user's CEFO tank 11. CEFO in storage tank 25 is supplied as needed to rack 26 for future delivery.

Turning to FIG. 2 catalyst metering device unit 17 is shown in detail. Unit 23 has similar construction. Water enters unit 17 in line 30 and passes through check valve 31 to static mixer 32. From static mixer 32 the flow in line 30 continues through flow sensor 33 and finally exits via line 30. Catalyst is added in controlled amounts at a tee section 36 located in and forming a part of line 30. Precious metal catalyst is storaged in a liquid in catalyst reservoir 37. Metering pump 38 supplies the catalyst liquid via tube 39 to mixing tee section 36 where the catalyst liquid is injected into the exit water line 30. Further mixing of the flowing water and the liquid catalyst is accomplished in in-line static mixer 32. Flow sensor 33 is electrically connected to pump pulser 42, which in turn is electrically connected to pump 38. In operation, the rate of flow through flow sensor 33 sends signals to pulser 42 which in turn controls the rate of pulsing of the metering pump 38 to increase or decrease the rate of flow of liquid catalyst to the water flowing through line 30. Calibration of the device is a function of varying the catalyst concentration in reservoir 37.

Catalyst material may be added as part of a liquid medium to the fuel or to emulsion as formed at any location prior to entry into the combustion chamber. Catalyst material may also be added in solid form provided mixing is adequate and provided that ranges of fuel to emulsifying liquid to catalyst are maintained.

In some instances, when substituting CEFO for lighter distillate fuel oils, burner equipment changes are necessitated. Specifically, it is often necessary to modify (retrofit) existing plant systems by the addition of an in-line fuel oil preheater and, in addition, add or substitute motors, pumps, nozzles, in-line oil filters and regulators used to measure flow rates and pressures.

Figure 3:
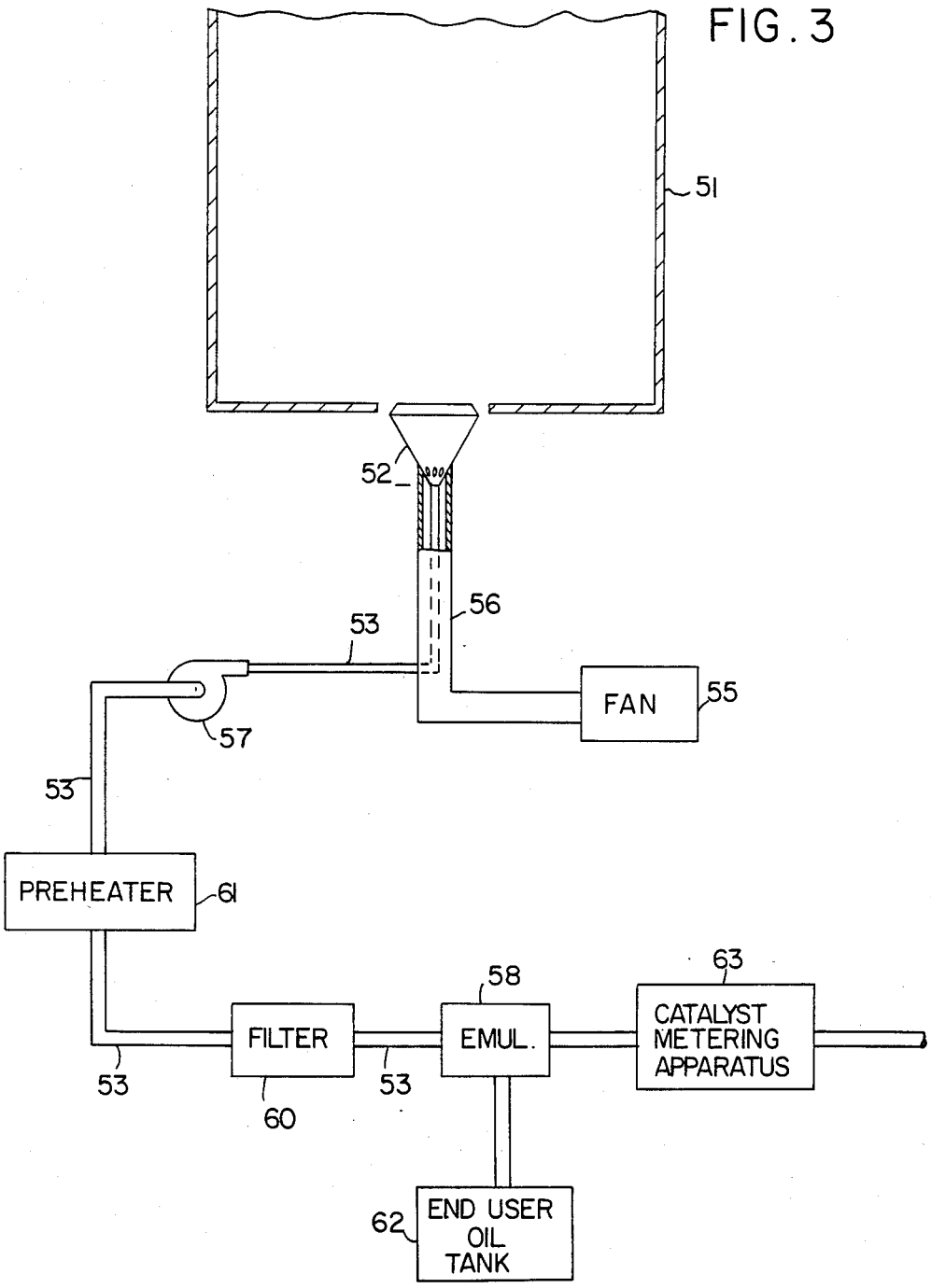
FIG. 3 is a schematic of a boiler having a flame zone in the combustion chamber, the combustion air and fuel supply systems, and equipment for treating fuel oil prior to burning.

FIG. 3 shows a furnace and attendant air and fuel supply system, combustion unit 51, burner nozzle assembly 52, fuel supply line 53, air supply fan 55 and duct 56. CEFO under action of the pump 57 is supplied from emulsifier 58 via line 53 through filter 60 and preheater 61. The emulsifier 58 is supplied with fuel oil from tank 62 and with liquid catalyst medium from catalyst unit 63. The CEFO may be heated in preheater 61 to temperatures in the range of 100°–220° F. and preferably in the range of about 120° F. to about 150° F. This burner system which was designed and operated to burn No. 2 fuel required the following modification to refit it for the more viscous No. 4 fuel:

1. addition of a preheater;
2. larger capacity pump (and larger motor to drive the pump);
3. new filter; and
4. new burner nozzle.

Turning now to FIG. 4 primary flame zone 71 in combustion chamber 72 is shown wherein the CEFO has been atomized as introduced via burner nozzle 73 into the hot chamber 72. Fuel oil droplet components 74 are shown enlarged as circles. Enlarged circles with blackened centers 76 illustrate water droplet components with catalyst therein. Interspersed amongst the fuel oil droplets and water droplets are micro-explosions of water droplets 77.

Through absorption of heat from the combustion flame, aqueous droplets are rapidly transformed from a liquid to a vapor state, creating micro-explosions 77 within combustion chamber 72. The intensity of the vaporization process creates pressure differentials, which in turn shatter the surrounding fuel oil into smaller droplets 76 thereby enhancing the efficiency and completeness of the combustion reaction.

At the site of each micro-explosion 77, the heat of combustion causes rapid dissociation and activation of the precious metal catalyst within the primary flame zone. This method of introduction of catalyst into the primary flame zone 71 ensures consistent optimal utilization of and realization of the beneficial effects derived from the active precious metal catalysts.

In tests performed to data, CEFO has been successfully burned under various operating conditions. It has been discovered that stable emulsions of oil and emulsifying liquid including water, in the range of about 3% by volume to about 15% by volume of emulsifying liquid to fuel oil, are useful in the practice of the invention. While the amount of emulsifying liquid used varies with the fuel used, it is necessary to use an amount of emulsifying liquid to create and maintain a stable emulsion. Among the factors used in determining the appropriate ratio of water to fuel oil is the viscosity of the base fuel oil. Fuel oils with a viscosity in excess of 60 SSU can be treated to form a stable homogenous emulsion. It has also been determined that the optimum water droplet size in the combustion chamber falls in the range of one to ten microns.

Data collected during CEFO testing has revealed the beneficial improvements directly attributable to the use of precious metal catalyst. Tests were performed using concentrations of small amounts of catalyst in the range of 0.005 ppm–0.5 ppm catalyst to fuel oil measured as catalyst metal on a weight basis. The preferred amount of catalyst to fuel oil fell within the range of about 0.02 to about 0.06 ppm by weight.

Among the noble metal catalysts useful in the practice of the present invention are:

ruthenium (IV) oxide
ruthenium (III) chloride
ruthenium (III) chloride trihydrate
ruthenium (III) bromide, and its hydrates
ammonium aquopentachlororuthenium (III), $(NH_4)_2RuCl_5.H_2O$
potassium ruthenium (VI) oxide
rhodium (III) oxide
rhodium (III) chloride, and its hydrates
rhodium (III) nitrate, and its hydrates
iridium (III) chloride
iridium (III) oxide
iridium (IV) oxide
hydrogen hexachloroiridium (IV), and its hydrates
ammonium hexachloroiridium (IV), and its hydrates
osmium tetroxide
osmium (III) chloride
platinum black
platinum (IV) oxide, and its hydrates
platinum (II) chloride
platinum (IV) chloride
hydrogen hexachloroplatinum (IV) hydrate
hydrogen hexahydroxoplatinum (IV)
tetraammineplatinum (II) chloride monohydrate
dinitritodiammineplatinum (II)
dihydrogen sulphatodinitrito platinum (II)
tetraammineplatinum (II) dinitrate
palladium (II) chloride
palladium (II) oxide
palladium (II) nitratedihydrate
ammonium hexachloropalladium (IV)

tetraamminepalladium (II) nitrate
potassium tetracyanopalladium (II) trihydrate
potassium perrhenate
rhenium (III) chloride
tris (acetyl acetonate) rhenium (III)
cis-Dichloro(2,2'-bipyridine)platinum (II), $PtCl_2(C_{10}H_8N_2)$
dichloro(1,5-cyclooctadiene)platinum (II), $PtCl_2(C_8H_{12})$
2-hydroxyethyanethiolato(2,2,'2''-terpyridine)platinum (II) nitrate, $[Pt(C_2H_5OS)(C_{15}H_{11}N_3)]NO_3$
tricarbonylchloro iridium (I), $[IrCl(CO)_3]n$
chloro(1,5-cyclooctadiene)iridium (I) dimer $[IrCl(C_8H_{12})]_2$
trans-dichlorobis(ethylenediamine), iridium (III) chloride, trans-$[IrCl_2(C_2H_8N_2)_2]Cl$
rhodium (II) octanoate dimer, $Rh_2[O_2C(CH_2)_6CH_3]_4$
acetylacetonato(1,5-cyclooctadiene), rhodium (I), $Rh(C_8H_{12})(C_5H_7O_2)$
acetylacetonato(norbornadiene), rhodium (I), $Rh(C_7H_8)(C_5H_7O_2)$
hydridotetrakis(triphenylphosphine), rhodium (I), $RhH(PPh_3)_4$
diacetatobis(triphenylphosphine), palladium (II) $(CH_3CO_2)_2Pd\ (PPh_3)_2$
Bis(dibenzylideneacetone), palladium (O) $Pd(C_{17}H_{14}O)_2$
Dichloro[1,2-bis(diphenylphosphino)ethane]palladium (II) $PdCl_2(Ph_2PCH_2CH_2PPh_2)$
Palladium (II) trifluoracetate $Pd(CF_3CO_2)_2$
Acetatohydridotris(triphenylphosphine)ruthenium (II) $RuH(OCOCH_3)(PPh_3)_3$
Bis(benzene)dichlorodi-$\mu$-chlorodiruthenium (II) $[RuCl_2(C_6H_6)_2]_2$
Tris(2,2'-bipyridine)ruthenium (O) $(C_{10}H_8N_2)_3Ru$
Carbonyldihydridotris(triphenylphosphine)ruthenium (II) $RuH_2(CO)(PPh_3)_3$
Bis(cyclopentadienyl)ruthenium (II) "Ruthenocene" $(C_5H_5)_2Ru$
Dihydridotetrakis(triphenylphosphine)ruthenium (II) $RuH_2(PPh_3)_4$
Ruthenium(III)hexafluoroacetylacetonate $Ru(CF_3COCHCOCF_3)_3$
Dichloroethylenediammineplatinum (II) $[Pt(C_2H_8N_2)Cl_2]$
Bis(acetylacetonato)platinum (II) $[Pt(C_5H_7O_2)_2]$
Dichlorobis(triphenylphosphine)platinum (II) $[PtCl_2(PPh_3)_2]$
Tetrakis(triphenylphosphine)platinum (O) $[Pt(PPh_3)_4]$
Bis(acetylacetonato)palladium (II) $[Pd(C_5H_7O_2)_2]$
Dichloro(cycloocta-1,5-diene)palladium (II) $[Pd(C_8H_{12})Cl_2]$
Chloro($\pi$-allyl)palladium (II) dimer $[Pd(\pi\text{-}C_3H_5)Cl]_2$
Palladium (II) acetate trimer $[Pd(CH_3CO_2)_2]_3$
Tris(acetylacetonato)ruthenium (III) $[Ru(C_5H_7O_2)_3]$
Hydridocarbonyltris(triphenylphosphine)rhodium (I) $[Rh(H)(CO)(PPh_3)_3]$
Acetylacetonatodicarbonylrhodium (I) $[Rh(CO)_2(C_5H_7O_2)]$
Tris(acetylacetonato)rhodium (III) $[Rh(C_5H_7O_2)_3]$
Bromotris(triphenylphosphine)rhodium (I) $[RhBr(PPh_3)_3]$
Rhodium (II) acetate dimer $[Rh_2(CO_2CH_3)_4]$
Tris(acetylacetonato)iridium (III) $[Ir(C_5H_7O_2)_3]$
Dodecacarbonyltriosmium (O) $Os_3(CO)_{12}$ While the above mentioned precious metal catalysts are preferred, other metal catalysts, both organo-metallic and inorganic-metallic can be employed in the present invention. Catalysts insoluble or insoluble in the emulsifying liquid may be used.

EXAMPLE I

A homogeneous emulsion fuel was burned in a 300 HP fine tube boiler set at its maximum firing rate of 112 gph, fuel—#6, emulsion—3.2% water by volume, catalyst—0.05 ppm by weight, preheated emulsion temperature—130° F.

Results: When burning the catalyzed homogenized emulsion fuel, the minimum excess air capability of the combustion system was reduced by an average of 1.8%, as compared to normal operating conditions. This was accomplished without any detectable increase in stack carbon monoxide emissions. Stack gas temperatures were reduced by approximately 16° F. See Table I, Runs I and II.

TABLE I

| | Oxygen A | Oxygen B | % CO | Exit Temp. |
|---|---|---|---|---|
| Run I | 2.3% | 1.9% | 0 | 722 |
| | 1.8 | 1.6 | 0 | 728 |
| | 1.7 | | 0 | |
| | 1.6 | 1.4 | .01% | 720 |
| | 1.5 | | .01± | |
| | 1.4 | | .02 | 712 |
| Run II | 5.4 | 4.3 | 0 | |
| | 2.1 | 1.8 | 0 | |
| | 1.8 | 1.6 | 0 | |
| | 1.6 | 1.5 | 0 to .01% | 712 |

Table I Key $O_2A$=readings from catalytic type oxygen analyzer with probe in the exhaust duct.
$O_2B$=readings from zirconium oxide type oxygen analyzer with probe in the exhaust duct reading "net" flue gas on a "wet" basis.
%CO=stack gas measured using Enerac instrument with its probe inserted in the exhaust duct.
Exit Temp.=stack gas temperature in degrees F.

EXAMPLE II

A catalyzed emulsion fuel was burned in a forced hot air residential furnace rated at 1 gph, equipped with a Wayneburner.

Fuel—#4
Emulsion—3% and 6% water by volume
Catalyst Concentration—0.03 ppm by weight
Burner rated—1-6 gph
Preheated emulsion temperature range—120°-220° F.
Firing rate—1.25 gph Modifications to system 1. Oil pump was replaced with a pump of higher capacity;
2. 1/6 HP burner/pump motor was replaced with a 0.25 HP burner/pump motor;
3. An in-line immersion type fuel oil preheater was installed in the homogenized emulsion feed line; and
4. String type element oil filters were replaced with strainer type oil filters.

Results: A consistent 4% average increase in thermal efficiency, and an average 300° F. increase in flame temperature (above normal operating conditions) were observed. Stack smoke emissions remained relatively constant. See Table II, Runs I and II.

TABLE II

| Emulsion | $T_o$ | $T_f$ | $T_{st}$ | $CO_2$ | $O_2$ | % Efficiency | Smoke | $P_o$ |
|---|---|---|---|---|---|---|---|---|
| Run I: | | | | | | | | |
| 6% water .03 ppm cat | 120 | 1900 | 700 | 7.7 | 10.8 | 66. | 4. | 100 |
| | 160 | 2100 | 735 | 8.5 | 9.9 | 67.6 | 3. | 100 |
| | 140 | | 765 | 8.6 | 9.8 | 66.4 | 4. | 100 |
| Run II: | | | | | | | | |
| 3% water .03 ppm cat | 230 | 1900 | 655 | 7.9 | 10.6 | 68.7 | 4. | 100 |
| | 180 | | | | | | | |
| | 160 | | 671 | 8.7 | 9.8 | 70.6 | 4. | 100 |
| | 150 | 2100 | 672 | 8.8 | 9.5 | 70.3 | 4. | 100 |
| | 120 | | 674 | 8.8 | 9.6 | 70.1 | | 100 |

Table II Key

Temperatures were measured with thermocouples.
$T_o$=emulsion preheat temperature
$T_f$=flame temperature (firebox)
$T_{st}$=exhaust duct temperature (ENERAC)

Gas composition was measured using an ENERAC (P50) instrument with the probe in the exhaust duct;

Thermal efficiency was indicated by the ENERAC instrument;

Smoke was measured using a Bacharach pump/filter and compariator chart; and $P_o$=emulsion pressure at the burner measured in pounds per square inch.

EXAMPLE III

A combustion burner system was operated using two fuels for comparison. First, the system was fired with normal (i.e., untreated) #4 fuel oil. Next, the same unit was fired with a #4 catalyzed emulsion fuel oil (CEFO).

Fuel—#4 (treated and normal)
Emulsion—3.8% water by volume
Catalyst concentration—0.038 ppm by weight
Burner firing rate—1.25 gph
Preheated emulsion temperature range—140°-180° F.

Results: The catalyzed emulsion fuel showed significantly improved combustion characteristics when compared to untreated #4 fuel oil. Average improvements were:

1. percent thermal efficiency increased 7.1%;
2. average flame temperature increased 247° F.;
3. average stack gas temperature decreased 136° C.;
4. $O_2$ readings decreased an average of 2.6%;
5. average $CO_2$ readings increased 2.1%; and
6. stack smoke emissions remained relatively constant (see Tables III and IIIA).

TABLE III

| Test | $T_o$ | $T_f$ | $T_{st}$ | $CO_2$ | $O_2$ | % Efficiency | Smoke | $P_o$ |
|---|---|---|---|---|---|---|---|---|
| #4 | 170 | 2050 | 730 | 11.4 | 6.2 | 73.9 | 4. | 100 |
| | 180 | 1900 | 680 | 9.5 | 8.6 | 71.5 | 3 | 75 |
| #4 | 170 | 2100 | 720 | 11.3 | 6.4 | 73.8 | 3. | 100 |
| | 170 | 2100 | 694 | 11.7 | 6. | 75.1 | | 100 |
| #4 | 175 | 200 | 670 | 9.7 | 8.5 | 72.5 | 3 | 75 |
| | 170 | 2050 | 630 | 10.4 | 7.6 | 74.5 | 3 | 75 |

TABLE IIIA

| Test | $T_o$ | $T_f$ | $T_{st}$ | $CO_2$ | $O_2$ | % Efficiency | Smoke | $P_o$ |
|---|---|---|---|---|---|---|---|---|
| 3% water with cat. | 140 | 2300 | 530 | 13.3 | 3.8 | 81.9 | 4 | 100 |
| | 180 | 2250 | 502 | 12.3 | 5.3 | 81.6 | 3 | 100 |
| | 150 | 2300 | 585 | 13.1 | 4.1 | 80.3 | 3 | 100 |
| | 175 | 2250 | 575 | 12.1 | 5.4 | 79.4 | 4 | 100 |
| | 140 | 2300 | 563 | 12.7 | 4.6 | 80.2 | 5 | 100 |

Tables III and IIIA Key $T_o$=oil preheat temperature
$T_f$=flame temperature
$T_{st}$=exhaust duct temperature
$P_o$=emulsion or fuel oil pressure at the burner measured in pounds per square inch
Smoke=Bacharach Number.

EXAMPLE IV

A 250 HP fire tube boiler was operated using three fuels for comparison. First, light distillate #2 fuel oil was fired in the combustion unit. Next, the same unit was fired using #4 fuel oil and water in emulsion form. Lastly, the unit was fired with #4 catalyzed emulsion fuel.

Fuels
#2 untreated
#4 with 6.2%, 6.3% and 8% water (by volume)
#4 with 2.8% and 3.5% water plus catalyst
Catalyst—concentration 0.51 ppm (by weight)
Burner firing rates—High (60 gph); Medium (20-30 gph)

Results: Improvements over #2 oil firing (averages):
High Fire: 6% emulsion; 2.1% increase in lbs. steam/gallon of oil 2% catalyst emulsion; 7.7% increase in lbs. steam/gallon of oil.
Medium Fire: 8% emulsion; 2.9% increase in lbs. steam/gallon of oil 3.5% catalyst emulsion; 11.9% increase in lbs. steam/gallon of oil
(see Table IV).

TABLE IV

Comparison of Performance #2 vs. Emulsion Fuels and Catalyst

| Firing Rate | Fuel | Emulsion | Catalyst | Combustion efficiency | % $O_2$ | Smoke | lbs. steam/gallon oil |
|---|---|---|---|---|---|---|---|
| High | #4 | 6.2% | No | 88. | 3. | 4. | 114.7 |
| | #4 | 6.3 | No | 87.4 | 5.4 | 2. | 111.7 |
| | #4 | 2.8 | Yes | 87.9 | 2.2 | 1./2. | 118.2 |
| | #2 | No | No | 87.7 | 3.5 | 4. | 112.3 |
| | #2 | No | No | 87.3 | 4.8 | 3. | 107.2 |
| Medium | #4 | 8.0 | No | 84.9 | 9.6 | 3. | 96.6 |
| | #4 | 3.5 | Yes | 89.2 | 2.1 | 1./2. | 105.1 |
| | #2 | No | No | 83. | 11.1 | 2./3. | 93.9 |

What is claimed is:

1. A method of improving the combustion of fuel in a chamber by treating the fuel to form a suspension comprising:
(a) mixing with such fuel a quantity of emulsifying liquid to form a stable suspension; and
(b) adding a small amount of precious metal catalyst so that such metal is present in such suspension prior to its introduction into such chamber.

2. The method of claim 1 in which the catalyst metal is first mixed with a liquid and introduced into the fuel to cause the catalyst to be present in the suspension.

3. The method of claim 1 in which the catalyst metal is first mixed with a liquid and introduced into the emulsifying liquid which in turn is mixed with the fuel.

4. The method of claim 1 in which the catalyst metal is first mixed with a liquid and then introduced into the formed suspension.

5. The method of claim 1 in which the catalyst metal in solid form is introduced into the fuel.

6. The method of claim 1 in which the catalyst metal in solid form is introduced into the emulsifying liquid.

7. The method of claim 1 in which the catalyst metal in solid form is introduced into the formed suspension.

8. The method of claim 1 in which the emulsifying liquid is water.

9. A method of improving the combustion of fuel in a chamber by treating the fuel to form a suspension comprising:

(a) admixing with a quantity of emulsifying liquid a small amount of precious metal catalyst to form a liquid catalyst medium;

(b) mixing the liquid catalyst medium with the fuel under turbulent conditions to form a stable suspension of fuel, emulsifying liquid and catalyst; and (c) thereafter introducing the suspension into the chamber for combustion therein.

10. The method of claim 9 in which the quantity of emulsifying liquid is about 3% to about 15% by volume to the fuel and the small amount of precious catalyst added to form the catalyst medium is an amount sufficient to provide from about 0.005 ppm to about 0.5 ppm catalyst metal by weight in the said suspension.

11. The method of claim 9 in which the small amount of precious metal catalyst added to form the catalyst medium is an amount sufficient to provide about 0.02 ppm to about 0.06 ppm catalyst metal in said suspension.

12. The method of claim 9 in which the suspension is stored for a substantial period of time.

13. The method of claim 9 in which the suspension is heated prior to its introduction into the chamber.

14. A treated liquid fuel comprising an emulsified suspension of (a) about 85% to about 97% by volume liquid carbonaceous fuel;

(b) about 15% to 3% water; and (c) about 0.005 ppm to about 0.5 ppm precious catalyst metal by weight.

15. A method of improving the combustion of fuel in a chamber by treating the fuel to form a suspension comprising:

(a) mixing with such fuel at least 3% by volume of an emulsifying liquid to form a stable suspension; and (b) adding a small amount of precious metal catalyst so that such metal is present in such suspension prior to its introduction into such chamber.

16. A method of improving the combustion of fuel in a chamber by treating the fuel to form a suspension comprising:

(a) admixing with at least 3% by volume of an emulsifying liquid a small amount of precious metal catalyst to form a liquid catalyst medium;

(b) mixing the liquid catalyst medium with the fuel under turbulent conditions to form a stable suspension of fuel, emulsifying liquid and catalyst; and (c) thereafter introducing the suspension into the chamber for combustion therein.

* * * * *